US005516556A

United States Patent [19]

Baker et al.

[11] Patent Number: 5,516,556

[45] Date of Patent: May 14, 1996

[54] COMPOSITION FOR AND METHOD OF TREATING SKATE BLADES AND THE LIKE

[76] Inventors: Larry J. Baker, 64 Brushwood Crescent, Barrie, Ontario, Canada, L4N 7E6; Harry H. White, RR 6, Site 10, Barrie, Ontario, Canada, L4M 5P5

[21] Appl. No.: 311,241

[22] Filed: Sep. 23, 1994

[51] Int. Cl.[6] ..... B05D 3/12

[52] U.S. Cl. ..... 427/355; 280/11.18; 280/28; 427/388.2; 428/463

[58] Field of Search ..... 427/355, 388.2; 428/421, 422, 463; 252/48.8; 280/11.18, 28

[56] References Cited

U.S. PATENT DOCUMENTS

| | | | |
|---|---|---|---|
| 3,658,742 | 4/1972 | Fish et al. | 260/29.6 F |
| 4,314,708 | 2/1982 | Zuuring | 280/28 X |
| 4,420,449 | 12/1983 | Crocker et al. | 264/68 |
| 5,049,722 | 9/1991 | Corfe et al. | 219/121.71 |
| 5,263,256 | 11/1993 | Trankiem | 428/422 X |

OTHER PUBLICATIONS

Billmeyer, Fred W.: "Textbook of Polymer Science", 1984, John Wiley & Sons, Inc., pp. 398–401.

*Primary Examiner*—Michael Lusignan
*Attorney, Agent, or Firm*—Jeffrey T. Imai; Arne I. Fors; D. Doak Horne

[57] ABSTRACT

A composition for treating skate blades has a polytetrafluoroethylene (PTFE) resin and a carrier. The carrier includes a wetting agent for dispersing the PTFE resin and an inert agent for reducing any volatility of the wetting agent and which will not contaminate ice. The composition is applied to the skate blade and burnished thereon for presenting a blade surface impregnated with PTFE resin and having a reduced coefficient of friction.

4 Claims, 1 Drawing Sheet

COMPOSITION FOR AND METHOD OF TREATING SKATE BLADES AND THE LIKE

FIELD OF INVENTION

This invention relates to a composition for treating skates blades and a method of treating skate blades using such composition. In particular, this invention relates to a novel composition for treating skate blades for improving the smoothness of the skating surface of the blade.

BACKGROUND OF INVENTION

For many years, the skate blade for ice hockey skates and the like has been made of carbon steel. Skate blades for figure skates and speed skating skates continue to be made from hardened and chromed high carbon steel. Recently stainless steel has replaced carbon steel for ice hockey skates as the material of choice. Stainless steel is less costly than chromed carbon steel yet retains much of the aesthetics of chromed steel.

Traditionally, the coefficient of friction of a skate blade running over an ice surface has always been considered to be a very low. Improvements to the coefficient of friction were believed to be only achievable by improved sharpening techniques.

Polytetrafluoroethylene or PTFE resins are well known compounds having a relatively low coefficient of friction. PTFE resins are better known under the trademark TEFLON. PTFE resins have a coefficient of friction which can be described as wet ice gliding over wet ice.

PTFE resins have been used in a variety of applications, including cookware, raincoats, boat hull applications, etc. However, PTFE resins have not been applied to skate blades and the like.

SUMMARY OF THE INVENTION

The disadvantages of the prior art may be overcome by applying a PTFE resin compound to a skate blade for improving the smoothness of the blade.

According to one aspect of the invention, there is provided a composition for treating skate blades comprising a PTFE resin and a carrier. The composition is applied to the skate blade and burnished thereon.

According to another aspect of the invention, there is provided a composition comprising between 1 and 12%, by volume, PTFE resins and equal parts isopropyl alcohol and propylene glycol.

According to another aspect of the invention, there is provided a method of treating a skate blade. The method comprises the steps of applying a composition comprising between 1 and 12%, by volume, PTFE resins and equal parts isopropyl alcohol and propylene glycol to a skating surface of a blade and then burnishing the composition therein.

According to another aspect of the invention, the composition is applied to the blade while the blade is at an elevated temperature as a result of sharpening.

According to another aspect of the invention, the method further includes the step of applying and burnishing an additional layer of the composition after a sessional use of the skate blade.

According to another aspect of the invention, an initial composition is applied while the blade is still at an elevated temperature, which initial composition has a higher concentration of PTFE resins than a maintenance composition, which is applied after usage of the skate blade.

DETAILED DESCRIPTION OF THE DRAWINGS

Figure 1:
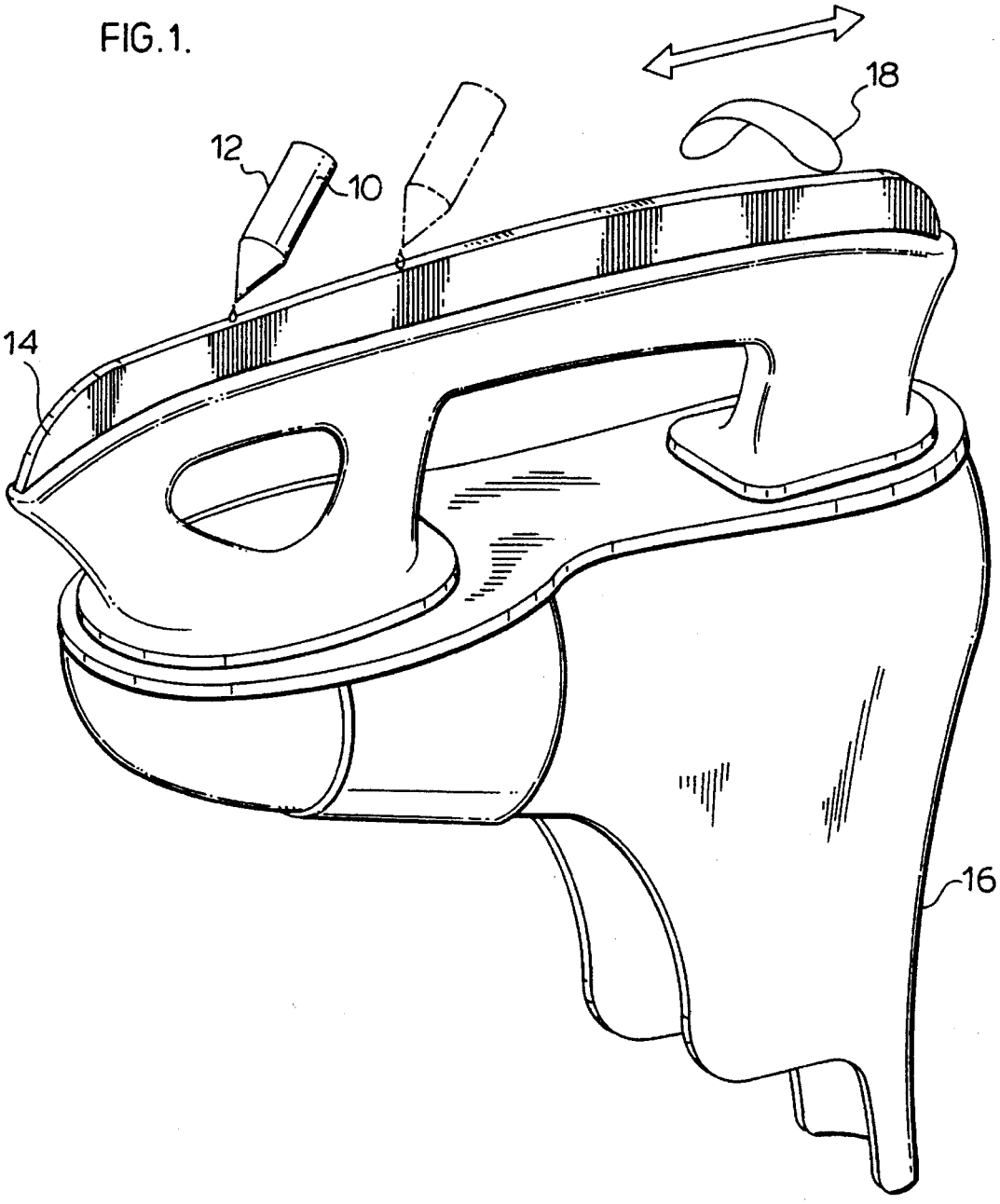

In figures which illustrate the embodiment of the invention,

FIG. 1 is a perspective view of an inverted skate blade having the composition of the present invention applied thereto and burnished.

DETAILED DESCRIPTION OF THE INVENTION

The present invention is a composition for treating skate blades for hockey, figure or speed skates. The treatment could easily be applied and used with other blades or runners for a luge, bobsled or even the edges of alpine or nordic skis.

The composition of the preferred embodiment of the present invention comprises between 1 and 12%, by volume, PTFE resins and a carrier comprising equal parts isopropyl alcohol and propylene glycol. A suitable PTFE resin is available under the trademark MP 1100 from Dupont. The resins preferably have a primary particle size of about 0.2 μm or 8 micro inches.

Alcohol, including isopropyl alcohol, acts as a wetting agent for the PTFE resins and will clean the blade surface during application. Alcohol is required to disperse the PTFE resin particles reducing the likelihood of the resin particles agglomerating since a PTFE resin particle has a strong affinity for itself and will stick to everything with which it comes into contact.

However, isopropyl alcohol is highly volatile. Propylene glycol is an inert agent which will reduce the volatility of the isopropyl alcohol and more importantly will not react with or contaminate the ice surface. Additionally, propylene glycol is not a WHMIS regulated product but isopropyl alcohol is and therefore, the overall combination is generally safe to use.

It is now apparent to those skilled in the art that other carriers, including wetting agent and inert agent pairs, will provide suitable results. All such carriers are intended to be within the scope of this invention.

Referring to FIG. 1 the method of applying the composition is illustrated. A drop bottle 12 is used to apply about 3 to 6 drops of the composition 10 along the length of the blade 14 of skate 16. For the best results, the blade should still be at an elevated temperature from the sharpening process. A strip of leather 18 is then used to burnish the composition into the blade 14.

Although the radius of hollow of a skate blade appears to be smooth after sharpening, microscopically, there are a series of pores or asperities, which look like hills and valleys, along the length of the radius. The burnishing of the blade with the PTFE resins causes the PTFE resins particles to impregnate the blade surface. The PTFE resin particles will also be forced into the valleys of the skate blade surface. The elevated temperature of the skate blade immediately after sharpening improves the impregnation of the PTFE resins to the skate blade. The impregnated PTFE resins will smooth and coat the surface of the blade, not only improving and reducing the roughness of the blade but also presenting a blade surface having a reduced coefficient of friction, allowing the blade to travel over an ice surface with reduced friction. The end result for the user is a superior rate of flow of the blade over the ice.

While the skate blade is still at an elevated temperature after sharpening, the pores or the asperities of the steel are at a maximum expansion. Thus, impregnation of the PTFE resin particles is enhanced.

The effectiveness of the treatment has been found to deteriorate as the skate is used. In order to maintain the optimum results, maintenance treatments can be applied. The user repeats the application after each session on ice and is repeated after each sharpening.

In a preferred embodiment, the initial composition which is applied immediately after sharpening has a higher concentration of PTFE resins than a maintenance composition used in between sharpenings. The preferred embodiment of the initial treatment has about 3 to 6%, by volume, PTFE resins and equal parts isopropyl alcohol and propylene glycol. The maintenance composition has about 1 to 3%, by volume, PTFE resins and equal parts isopropyl alcohol and propylene glycol.

Testing of the improved surface of a skate blade was undertaken on a MITUTOYO SURFTEST 211-178 surface testing machine. Sample skates were sharpened by a master skate sharpener and then the composition of the present invention was applied using the method described above. Prior to testing, the blades were washed with isopropyl alcohol and air dried. Samples of composition having a PTFE content of between 1 and 12%, by volume, were tested. The results are summarized in the following table:

| % PTFE Resin | % Change $R_a$ | % Change $R_{max}$ |
|---|---|---|
| 12 | 12.5 | 9.6 |
| 6 | 0 | 6.2 |
| 3 | 22 | 32.6 |
| 2.5 | 13.9 | 2.7 |
| 2 | 0 | 14.4 |
| 1.5 | 0 | 15.1 |
| 1 | 0 | 20.4 |

Note: $R_a$ is the arithmetical mean of the absolute values of the distances from the arithmetic mean line to the roughness profile and $R_{max}$ is the maximum peak to valley height.

Based on the results of the testing, the preferred initial composition has, by volume 3% PTFE resin having a particulate size of 0.2 microns and 48.5% isopropyl alcohol and 48.5% propylene glycol. The preferred maintenance composition has, by volume 2% PTFE resin having a primary particle size of about 0.2 μm and 49.0% isopropyl alcohol and 49.0% propylene glycol.

The size of the primary particle size of the PTFE resin could be increased slightly in cases of a poorly sharpened skate blade having a roughened surface, for instance, if the blade has been mistreated or the sharpening equipment is not in top condition.

It is now apparent to a person skilled in the art that the skate blade treatment of the present invention could be readily modified. It is understood that certain changes in components may be effective without departure from the spirit of the invention and within the scope of the appended claims.

We claim:

1. A method of treating a blade comprising the steps of:

applying to a blade surface an initial liquid composition comprising a polytetrafluoroethylene resin dispersed in a suitable carrier, and burnishing the initial liquid composition into the blade surface.

2. A method of treating a blade as claimed in claim 1 wherein the method further includes the step of periodically applying a maintenance liquid composition comprising a polytetrafluoroethylene resin and a suitable carrier in between sessional use of the blade and burnishing the maintenance liquid composition into the blade surface.

3. A method as claimed in claim 2 wherein the maintenance liquid composition has, by volume, an amount of polytetrafluoroethylene resin less than an amount, by volume, of polytetrafluoroethylene resin of said initial liquid composition.

4. A method as claimed in claim 2 wherein said initial liquid composition has between 3 and 12%, by volume polytetrafluoroethylene resin and said maintenance liquid composition has between 1 and 3%, by volume polytetrafluoroethylene resin.

* * * * *